United States Patent [19]

Muscatell

[11] 4,295,450

[45] Oct. 20, 1981

[54] THERMAL AND VACUUM TRACKING CARBURETOR JET

[76] Inventor: Ralph Muscatell, 200 N.E. 20th Ave., Fort Lauderdale, Fla. 33305

[21] Appl. No.: 970,994

[22] Filed: Dec. 19, 1978

[51] Int. Cl.[3] ..... F02M 7/00; F02M 1/04

[52] U.S. Cl. ..... 123/435; 261/39 B; 261/37 D; 261/50 A; 261/69 R

[58] Field of Search ..... 261/50 A, 39 D, 39 B, 261/69 R; 60/285; 123/435

[56] References Cited

U.S. PATENT DOCUMENTS

| | | | |
|---|---|---|---|
| 2,250,292 | 7/1941 | Boyce | 261/69 R X |
| 2,563,645 | 8/1951 | Ericson | 261/39 D |
| 2,675,792 | 4/1954 | Brown et al. | 261/69 R |
| 2,969,965 | 1/1961 | Braun | 261/39 B |
| 3,263,974 | 8/1966 | Braun et al. | 261/50 A |
| 3,272,488 | 9/1966 | Bickhaus | 261/50 A |
| 3,278,171 | 10/1966 | Carlson | 261/39 D |
| 3,350,072 | 10/1967 | Thomas | 261/39 D |
| 4,172,864 | 10/1979 | Hohsho et al. | 261/39 D |
| 4,192,140 | 3/1980 | Yamashita et al. | 60/285 |

*Primary Examiner*—Wendell E. Burns

[57] ABSTRACT

The thermal and vacuum tracking carburetor Jet is a variable size jet. The opening size is continuously controlled by a thermal spring transducer measuring the temperature of the exhaust gasses, and by a vacuum diaphragm transducer measuring the vacuum within the intake manifold of the engine. When exhaust gasses become too hot indicating too lean a fuel mixture the thermal spring expands opening the jet; if the gasses are too cool the spring contracts and via mechanical linkage, the jet closes. When engine vacuum falls indicating more of a load is placed on the engine the vacuum diaphragm transducer opens the jet providing a richer mixture; when vacuum rises indicating a lessened load or deceleration the jet closes producing a leaner mixture.

2 Claims, 5 Drawing Figures

THERMAL AND VACUUM TRACKING CARBURETOR JET

Figure 1:
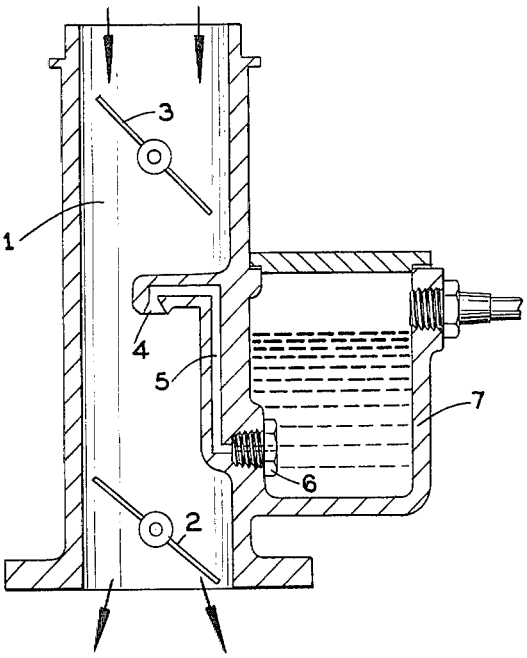
FIG. 1—FIG. 1 illustrates a basic carburetor not including the invention of the instant application. The air passage venturi tube (1) includes the throttle butteerfly valve (2) and choke butterfly valve (3). Also included within the air passage tube or venturi tube is a fuel induction spray head and associated pipeing (5) to the carburetor main JET (6). The main jet is basically and commonly a brass bolt with a precisely sized hole. It is located within the carburetor fuel supply—the float chamber (7). The main jet connects to the piping which connects to the spray head as shown.
Figure 2:
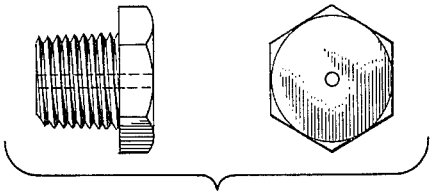
FIG. 2—FIG. 2 illustrates a common typical main jet. It is exactly similar to a brass bolt with a precisely sized hole through the middle of the longitudinal axis.

The plunger actuating shaft (10) is pivotally attached to common actuating bar (14). Common Actuating bar (14) is hingedly attached to slidable sleeve (15) which is slidably affixed onto support shaft (16).

Thermal spring transducer (18) is shown attached to float chamber (7) and with exhaust gasses inlet (19) and outlet (20). The thermal spring within ridgidly attached at one end at (22) and attached to slidable connector (23) at the other. The thermal transducer slidable connector (23) attaches to the slidable sleeve (15) by means of pivotally connected tie rod (17).

Attached to Float chamber (7) is vacuum transducer (24) with vacuum connector inlet (25). The vacuum transducer actuating rod (26) connects pivotally to common actuating bar (14).

BRIEF SUMMARY OF THE INVENTION

The carburetor regulates the Air-Fuel mixture admitted to the cylinders of reciprocating engines. In operation the pistons create a vacuum when descending in their cylinders. Air Flows to fill the vacuum through the air passage or Venturi tube of the carburetor. Carburetors include a butterfly valve within the air passage tube which regulates the amount of Air-Fuel mixture admitted and thus the power and speed of the motor. In accordance with established physical laws of nature the rapid passage of air through the air passage tube creates a low pressure area within the tube known as Venturi effect. A fuel spray outlet is located at the venturi; fuel is admitted to the spray apparatus from a fuel resevoir and via a JET. The Jet is commonally a brass bolt with a hole through the center. The Size of the hole is Very precisely sized for it is the size of this hole which determines how much fuel is admitted into the airstream flowing through the venturi. The air fuel ratio by weight for best all around performance has been found to be approximately 15 to 1. A leaner mixture, it has been found, produces detrimental effects such as greatly increased burning temperatures and subsequently reduced power.

However: The fuel and air ratio must be set to maintain satisfactory performance at the more demanding regimes of operation. The fixed ratio must be correct for hours of cruising at high speeds with attendant head winds, frictional and wind resistances and even different weights of air (per volume) as are found at higher altitudes. Though the outside air temperature can vary 120 degrees from summer to winter the Air-Fuel ratio must be pre-set to the more critical situation—With The Present Art. It is to the most demanding regime requirement that this Invention is directed.

Accordingly: It is an object of this invention to provide a Air-fuel ratio variability which will meet each regime of operation with the optimum Air Fuel ratio consistant with engine durability (burning temperatures) and power requirements; and ultimately therefore the most economical operation.

The Invention consists of a Jet similar to the present art; but one to which the orifice or hole is fitted with a tapered plunger which is slidable in and out of the Jet. Thus as the plunger is slid out the effective orifice becomes larger, as it is slid in the effective orifice becomes smaller—a smaller jet.

The movement of the tapered plunger is controlled by a thermal spring transducer and colatterally by a vacuum transducer Thus: as exhaust gasses become too hot the thermal spring expands and the tapered plunger retracts richening the mixture slightly and until the exhaust gas temperature goes into the safe region. Relatively cooler gasses will cause the thermal spring to contract thus moving the plunger in resulting in a leaner mixture; and so the mixture tracks the exhaust gas temperature.

The movement of the tapered plunger is also simultaneously controled by the action of a vacuum transducer via a common bar connector. As increased power is required, for example when an automobile meets a slight grade, or when the wind switches to a head wind the engine vacuum reacts—it lessons. As the vacuum lessons the transducer reacts and via an actuating rod the common bar and thus the tapered plunger is withdrawn, thus providing a richer mixture. As the vacuum builds with reduced power requirement, as when the wind switches to behind the vacuum transducer reacts, and thus via linkage the tapered plunger slides in resulting in optimum mixture. Thus the mixture tracks the vacuum.

Thus contrasting requirements for Air Fuel ratios, as for example in the automobile: a 35 MPH cruise no wind in the cold or the winter versus high speed cruise in the heat of the summer; in each case optimum fuel air ratio consistent with optimum temperatures and power is provided.

There are other ways mechanically to track the temperatures of the exhaust gasses and the vacuum to control the Air-Fuel mixture. It is not intended that this invention be limited to only the mechanical method presented in the instant application.

Many carburetors, particularily those in automotive application, include means of enriching the mixture to meet increased power required as for acceleration. One means is a power valve which is simply the opening of a bypass route around the main Jet to provide additional fuel into the pipe then spray head. A second means is to provide a plunger pump which squirts additional fuel into the airstream. The plunger pump acts as the throttle is opened. (accelerator pump).

It is intended that the present invention may be used in conjunction with these enrichment methods and that it May supplant the bypass (power valve) route method.

DETAILED DESCRIPTION

Figure 4:
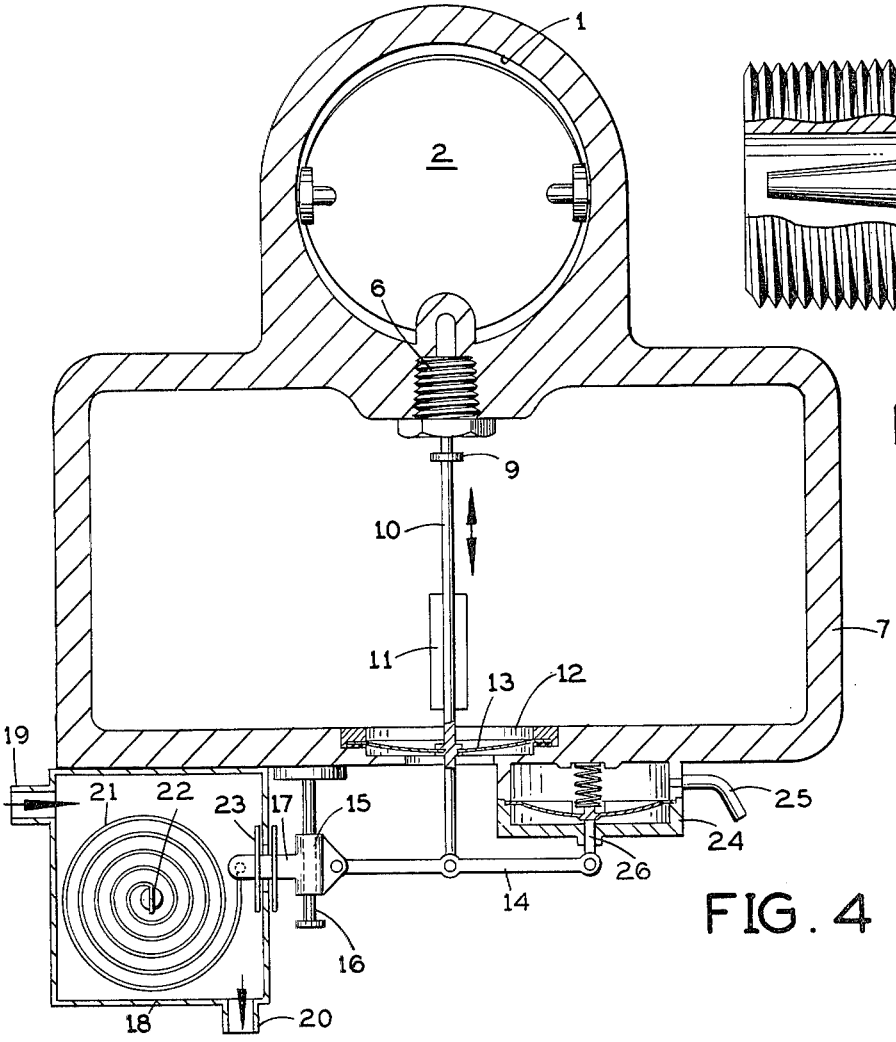
—FIG. 4 illustrates the instant invention. A top view of the carburetor is presented including conventional parts, air passage or venturi tube (1) with choke (2) and throttle (3) butterfly valves. Float chamber-Fuel resevoir (7) affixed and adjacent to the air passage or venturi tube (1). Within the float chamber is varaible orifice main jet (6) with associated tapered plunger (9) and connected to piping and spray head within venturi tube (not shown) (see FIG. (1).). The tapered plunger (9) is affixed to actuating shaft (10) which is supported—slidibly—by sleeve (11). Actuating shaft (10) passes through float chamber wall (7) (12) by means of a flexible membrane (13).

The Thermal and Vacuum Tracking Carburetor Jet invention is an improvement to the basic carburetor consisting essentially of an Air passage venturi tube (1) FIGS. 1 and 4 and associated and affixed Fuel Resivior or float chamber each of which is connected by a spray head with pipe and Jet, by which fuel is metered and sprayed into the airstream (1)(7)(4)(5)(6), FIG. (1).

Figure 3B:
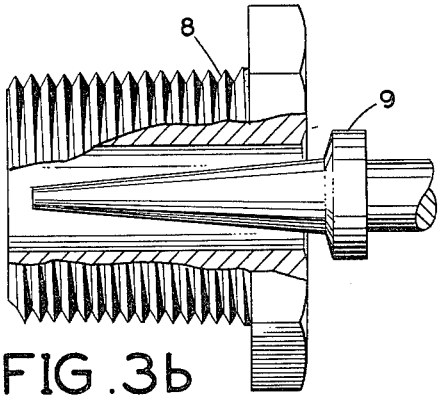
FIG. 3*a* and FIG. 3*b*—FIG. 3*a* and FIG. 3*b* illustrate the invention of the variable size orifice Main jet. The variable orifice main jet is basically a bolt (commonally brass) with a hole through the center on the longitudinal axis (similar to the present art), and to which is fitted a tapered plunger which fits and travels within the main jet orifice FIG. 4
Figure 3A:
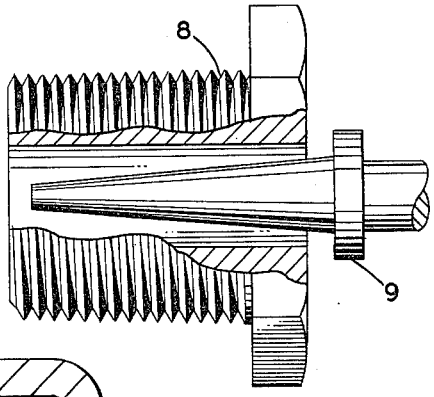

In addition to the basic carburetor there is a variable orifice size main Jet. The variable orifice main jet is basically a bolt (commonally brass) with a hole through the center on the longitudinal axis (similar to the present art), and to which is fitted a tapered plunger which fits and travels within the main jet orifice FIGS. 3 *a,b.* (8) (9). As the tapered plunger travels into the main jet it is effectively a smaller jet. As the plunger travels out of the jet orifice the jet effectively becomes larger.

In addition to the basic carburetor and variable size main Jet there is a Thermal Spring Transducer. The thermal spring transducer in FIG. 4 is a temperature sensitive spring (21) within an enclosed housing through which exhaust gasses are passed. The spring is anchored securely at one end and attached to a slidable connector at the other (23).

In addition to the basic carburetor, variable size main jet and thermal spring transducer there is a vacuum transducer (24) FIG. 4.

The vacuum transducer is a flexible diaphragm within a container which is sealed air tight in a section on one side of the diaphragm. The diaphragm action is caused by engine vacuum by means of a connecting hose from the sealed portion to the engine intake manifold.

In addition to the basic carburetor, variable size main jet, Thermal spring transducer and vacuum transducer there is a slidable actuating shaft (10) FIG. 4 supported by sleeve (11) and passing through the float chamber wall (12) by use of a sealing yet flexible membrane (13). The actuating shaft is pivotally attached to the common actuating bar (14). There is a support shaft (16) with slidable sleeve (15) and connecting tie rod (17). There is an actuating rod (26) connecting the vacuum transducer to the common actuating bar (14).

The basic carburetor also includes a power valve (bypass valve) and accelerator pump for fuel enrichment (not shown). The invention is intended to operate in conjunction with these valves as does the present art—fixed size orifice main jet. The invention may supplant the power valve.

In operation exhaust gasses pass through the thermal spring transducer (18) entering via inlet (19) and exiting via exit (20). The thermal spring within (21) is anchored firmly at one end (22) and pivotally to slidable connector (23) at the other.

Hot gasses will cause spring (21) to expand moving slidable connector (23) down (away from caburetor). Slidable sleeve (15) is thus moved down support shaft (16) according to it's connection to slidable connector (23) via tie rod (17). Thus common actuating bar (14) is moved causing actuating shaft (10) to move out and consequently tapered plunger (9) to which it is attached. Should relatively cool exhaust gasses flow over the spring (21) the reverse action will take place; thus the main jet (enrichment) thermally tracks the exhaust gas temperature.

In operation lessoning of vacuum as when greater power is required will result in the vacuum entering the vacuum transducer (24) at connector (25) to lesson. At this the diaphragm will move away from the float chamber (downward FIG. 4). Actuating rod (26) thus moves common actuating bar (14) away and which results in actuating shaft (10) moving and thus tapered plunger (9) to which it is attached moves out of the main jet—the mixture is thus enriched to meet the increases power requirement. Should vacuum increase as when lesser power is required the diaphragm would move the other direction as would all the other associated parts, Thus: the main jet (enrichment) tracks the engine vacuum.

THUS: the main jet (enrichment) tracks the exhaust gas temperature and the engine vacuum giving the leanest mixture consistant with safety (burning temperatures), power requirement, and environmental factors such as air temperature.

I claim:

1. In a carburetor system for an internal combustion engine, said system having:

means defining a fuel chamber;

a fuel mixing conduit having an air inlet at one end and a fuel/air outlet at the opposite end, a venturi throat between said inlet and said outlet, and a throttle valve between said throat and said outlet;

a fuel nozzle operatively arranged to discharge fuel into said throat;

means defining a metering orifice operatively connected between said fuel chamber and said nozzle to supply fuel to said nozzle;

a valve member adjustably positioned at said metering orifice to control the flow of fuel therethrough;

and means responsive to the engine vacuum to adjust said valve member in a direction to increase the flow of fuel to said nozzle when the engine vacuum diminishes and in the opposite direction to decrease the flow of fuel to said nozzle when the engine vacuum increases;

the improvement which comprises:

a temperature sensor operatively arranged to sense the temperature of the engine exhaust;

and means acting between said temperature sensor and said valve member to adjust the latter in a direction to increase the flow of fuel to said nozzle in response to an increased temperature of the engine exhaust and in the opposite direction to decrease the flow of fuel to said nozzle in response to a decreased temperature of the engine exhaust, whereby the richness of the fuel/air mixture is controlled jointly by the engine vacuum and the engine exhaust temperature.

2. A carburetor system according to claim 1, wherein:

said means responsive to the engine vacuum comprises a pressure-sensitive diaphragm movable in response to changes in the engine vacuum;

said temperature sensor comprises a spirally-wound element which expands with a temperature increase and contracts with a temperature decrease;

and said means acting between said temperature sensor and said valve member comprises a reciprocable bar operatively coupled intermediate its ends to said valve member for positioning the latter, said bar being operatively coupled at one end to said temperature sensor so that said one end of the bar moves with temperature changes in the engine exhaust, and said bar being operatively coupled at its opposite end to said diaphragm so that said opposite end of the bar moves with changes in the engine vacuum.

* * * * *